US009828824B2

(12) United States Patent
McAuley et al.

(10) Patent No.: US 9,828,824 B2
(45) Date of Patent: Nov. 28, 2017

(54) HYDRAULIC RE-CONFIGURABLE AND SUBSEA REPAIRABLE CONTROL SYSTEM FOR DEEPWATER BLOW-OUT PREVENTERS

(71) Applicant: Hydril USA Distribution, LLC, Houston, TX (US)

(72) Inventors: Alexander Michael McAuley, Houston, TX (US); James Matthew Nolan, Houston, TX (US); David Samuel Kindt, Houston, TX (US); Zachary William Stewart, Houston, TX (US)

(73) Assignee: Hydril USA Distribution, LLC, Houston, TX (US)

( * ) Notice: Subject to any disclaimer, the term of this patent is extended or adjusted under 35 U.S.C. 154(b) by 6 days.

(21) Appl. No.: 14/938,599

(22) Filed: Nov. 11, 2015

(65) Prior Publication Data

US 2016/0319622 A1 Nov. 3, 2016

Related U.S. Application Data

(60) Provisional application No. 62/155,671, filed on May 1, 2015.

(51) Int. Cl.
*E21B 33/038* (2006.01)
*E21B 43/013* (2006.01)
(Continued)

(52) U.S. Cl.
CPC ..... *E21B 33/06* (2013.01); *E21B 34/16* (2013.01)

(58) Field of Classification Search
CPC ..... E21B 33/038; E21B 43/013; E21B 33/035
(Continued)

(56) References Cited

U.S. PATENT DOCUMENTS 3,664,376 A * 5/1972 Watkins ..... E21B 23/002 137/625.68
3,865,142 A * 2/1975 Begun ..... E21B 33/0355 137/236.1

(Continued)

FOREIGN PATENT DOCUMENTS

CN 201250646 Y 6/2009
WO 0001915 A2 1/2000
WO 2013192494 A1 12/2013

OTHER PUBLICATIONS

John S. Holmes et al., filed Sep. 30, 2015, U.S. Appl. No. 14/870,249.

(Continued)

*Primary Examiner* — Matthew R Buck
*Assistant Examiner* — Edwin Toledo-Duran
(74) *Attorney, Agent, or Firm* — Hogan Lovells US LLP

(57) ABSTRACT

Blowout preventer (BOP) systems and methods for providing additional redundancy and reliability are provided. A BOP system for providing additional redundancy can include a first set of components including a BOP control pod with a primary regulator and a secondary regulator, where the primary regulator and the secondary regulator are arranged in a parallel configuration; a hydraulic supply line in communication with the BOP control pod; a pod select valve in communication with the primary regulator and the secondary regulator; and a bypassable hydraulic regulator in communication with the pod select valve; and a second set of components, the bypassable hydraulic regulator disposed between the pod select valve and the second set of components, where a hydraulic regulator bypass line bypasses the bypassable hydraulic regulator between the pod select valve and the second set of components.

20 Claims, 14 Drawing Sheets

(51) Int. Cl.
*E21B 33/035* (2006.01)
*E21B 33/06* (2006.01)
*E21B 34/16* (2006.01)

(58) Field of Classification Search
USPC ..... 166/368, 344, 347; 251/1.1
See application file for complete search history.

(56) References Cited

U.S. PATENT DOCUMENTS 3,902,554 A * 9/1975 Hooper ..... E21B 15/02 114/264
3,957,079 A * 5/1976 Whiteman ..... E21B 33/0355 137/596.18
4,095,421 A * 6/1978 Silcox ..... E21B 33/0355 137/236.1
4,109,938 A * 8/1978 Mitchell ..... B42D 1/007 283/43
4,174,000 A * 11/1979 Milberger ..... E21B 33/0355 137/236.1
4,413,642 A * 11/1983 Smith ..... E21B 34/16 137/102
4,453,566 A * 6/1984 Henderson, Jr. ..... F16L 39/02 137/236.1
4,524,832 A * 6/1985 Roche ..... E21B 21/001 166/347
4,565,349 A * 1/1986 Tomlin ..... E21B 33/0355 251/29
4,597,447 A * 7/1986 Roche ..... E21B 21/106 166/347
4,618,173 A * 10/1986 Dopyera ..... F16L 27/053 285/261
4,709,726 A * 12/1987 Fitzgibbons ..... E21B 33/038 137/614.04
5,314,024 A * 5/1994 Rodgers ..... F16L 27/06 166/347
5,778,918 A * 7/1998 McLelland ..... E21B 33/0355 137/15.02
5,781,192 A * 7/1998 Kodimer ..... G06F 9/543 715/770
5,867,150 A * 2/1999 Bricklin ..... G06F 17/30259 345/173
6,012,518 A * 1/2000 Pringle ..... E21B 23/04 166/147
6,040,969 A * 3/2000 Winch ..... H02H 11/002 307/127
6,041,804 A * 3/2000 Chatufale ..... E21B 34/04 137/15.23
6,053,202 A * 4/2000 Cunningham ..... E21B 34/10 137/596.16
6,070,668 A * 6/2000 Parks ..... E21B 17/085 166/242.1
6,102,124 A * 8/2000 Skeels ..... E21B 33/0355 166/347
6,227,300 B1 * 5/2001 Cunningham ..... E21B 33/035 166/339
6,293,344 B1 * 9/2001 Nixon ..... E21B 34/045 166/321
6,491,106 B1 * 12/2002 Simonds ..... E21B 34/10 166/321
6,622,799 B2 * 9/2003 Dean ..... E21B 33/0355 166/339
6,761,222 B2 * 7/2004 Wilson ..... E21B 33/127 166/187
6,835,292 B2 * 12/2004 Sato ..... B24B 37/042 204/224 M
6,957,205 B1 * 10/2005 Liongosari ..... G06N 5/022 706/45
6,961,226 B2 * 11/2005 Mason, Jr. ..... H02H 1/06 361/42
6,990,498 B2 * 1/2006 Fenton ..... G06F 17/3089
7,000,890 B2 * 2/2006 Bell ..... E21B 34/04 251/129.15
7,111,874 B2 * 9/2006 Smith, III ..... F16L 17/02 277/602
7,113,668 B2 * 9/2006 Sorum ..... H04B 3/56 385/147
7,216,715 B2 * 5/2007 Reynolds ..... E21B 33/035 166/339
7,222,674 B2 * 5/2007 Reynolds ..... E21B 33/035 166/341
7,261,162 B2 * 8/2007 Deans ..... E21B 41/0007 166/250.01
7,337,848 B2 * 3/2008 Fraser ..... E21B 17/01 166/344
7,410,003 B2 * 8/2008 Ravensbergen ..... E21B 33/06 166/384
7,558,684 B2 * 7/2009 Patten ..... G01F 1/00 702/100
7,571,772 B2 * 8/2009 Reams ..... E21B 17/01 166/344
7,760,670 B2 * 7/2010 Causier ..... H04B 3/54 340/853.1
7,832,706 B2 * 11/2010 Judge ..... E21B 33/062 166/85.4
7,849,599 B2 * 12/2010 Huff ..... B23K 9/18 148/328
7,887,103 B2 * 2/2011 Evans ..... F16L 15/008 285/333
7,913,767 B2 * 3/2011 Larson ..... E21B 17/085 166/242.6
7,975,770 B2 * 7/2011 Keener ..... E21B 19/002 166/339
8,011,436 B2 * 9/2011 Christie ..... E21B 33/035 166/338
8,020,623 B2 * 9/2011 Parks ..... E21B 33/0355 166/339
8,054,593 B2 * 11/2011 Reid ..... G01R 19/0092 324/222
8,157,025 B2 * 4/2012 Johnson ..... E21B 7/067 175/101
8,157,295 B2 * 4/2012 Krywitsky ..... F16L 27/06 285/263
8,230,735 B2 * 7/2012 Chouzenoux ..... G01F 1/44 702/100
8,322,436 B2 * 12/2012 Maa ..... E21B 19/002 166/338
8,376,051 B2 * 2/2013 McGrath ..... E21B 33/06 166/344
8,388,255 B2 * 3/2013 Larson ..... E21B 19/004 285/26
8,403,053 B2 * 3/2013 Judge ..... E21B 33/0355 166/250.01
8,464,797 B2 * 6/2013 Singh ..... E21B 33/0355 166/340
8,469,048 B2 * 6/2013 Bresnahan ..... F15B 13/028 137/112
8,602,108 B2 * 12/2013 Mathis ..... E21B 33/0355 166/250.01
8,684,092 B2 4/2014 McGrath
8,708,054 B2 * 4/2014 Dailey, Jr. ..... E21B 33/0355 166/250.01
8,724,957 B2 * 5/2014 Oisel ..... G11B 27/034 386/200
8,781,743 B2 * 7/2014 McKay ..... E21B 33/064 175/25
8,812,274 B2 * 8/2014 Virkar ..... G06K 9/6232 703/2
8,944,403 B2 * 2/2015 Jurena ..... E21B 33/062 166/85.4
9,057,751 B2 * 6/2015 Spencer ..... G01R 31/025
9,085,948 B2 * 7/2015 Egeland ..... E21B 33/064
9,151,794 B2 * 10/2015 Radan ..... G01R 31/025
2003/0024705 A1 * 2/2003 Whitby ..... E21B 33/064 166/363
2005/0199286 A1 * 9/2005 Appleford ..... F17D 3/00 137/487.5
2007/0107904 A1 * 5/2007 Donahue ..... E21B 33/0355 166/345

(56) References Cited

U.S. PATENT DOCUMENTS

2009/0095464 A1* 4/2009 McGrath ..... E21B 33/06 166/53
2010/0300696 A1* 12/2010 McCalvin ..... E21B 41/0007 166/336
2011/0266002 A1* 11/2011 Singh ..... E21B 33/0355 166/339
2012/0018165 A1* 1/2012 Crossley ..... E21B 33/037 166/344
2012/0197527 A1* 8/2012 McKay ..... E21B 41/0007 702/6
2012/0205561 A1* 8/2012 Baugh ..... E21B 33/063 251/1.1
2012/0233128 A1* 9/2012 Solmer ..... G06K 9/00442 707/661
2012/0234416 A1* 9/2012 McMiles ..... F15B 13/0435 137/625.6
2012/0312546 A1* 12/2012 Bussear ..... E21B 34/06 166/373
2012/0318517 A1* 12/2012 Christensen ..... E21B 17/07 166/345
2013/0054034 A1* 2/2013 Ebenezer ..... E21B 33/06 700/282
2013/0118755 A1* 5/2013 Kotrla ..... E21B 33/0355 166/363
2013/0253872 A1* 9/2013 Curtis ..... G01F 25/0007 702/100
2013/0255956 A1* 10/2013 Gilmore ..... E21B 17/07 166/345
2013/0283919 A1* 10/2013 Coonrod ..... E21B 33/0355 73/632
2014/0048274 A1* 2/2014 Reynolds ..... E21B 33/064 166/338
2014/0061516 A1* 3/2014 Gustafson ..... E21B 33/0355 251/28
2014/0064029 A1* 3/2014 Jaffrey ..... E21B 33/0355 367/81
2014/0321341 A1* 10/2014 Kristiansen ..... E21B 33/0355 370/297
2014/0361785 A1* 12/2014 Radan ..... G01R 31/085 324/521
2015/0015066 A1* 1/2015 Dong ..... H02H 3/16 307/18
2015/0041122 A1* 2/2015 Valsecchi ..... E21B 47/10 166/250.15
2015/0101674 A1* 4/2015 Gustafson ..... E21B 34/045 137/14
2015/0129233 A1* 5/2015 Gaude ..... E21B 33/064 166/344
2015/0184505 A1* 7/2015 Panicker-Shah .... E21B 33/0355 702/9
2015/0198001 A1* 7/2015 McWhorter ..... E21B 33/064 166/336
2015/0233202 A1* 8/2015 Caldwell ..... E21B 33/038 166/340
2015/0260203 A1* 9/2015 Launonen ..... H01F 27/14 138/31

OTHER PUBLICATIONS

John Steven Holmes et al., filed Oct. 15, 2015. U.S. Appl. No. 14/884,563.
John S. Holmes et al., filed Nov. 11, 2015, U.S. Appl. No. 14/938,074.
Alex David Stibich et al., filed Dec. 9, 2015, U.S. Appl. No. 14/963,849.
Glen Allen Scott et al., filed Dec. 17, 2015, U.S. Appl. No. 14/972,848.
Michael James Connor et al., filed Dec. 16, 2015, U.S. Appl. No. 14/971,381.
William James Hatter et al., filed Dec. 17, 2015, U.S. Appl. No. 14/972,266.
Thomas David Beales et al., filed Dec. 16, 2015, U.S. Appl. No. 14/971,669.
Thomas David Beales et al., filed Dec. 16, 2015, U.S. Appl. No. 14/971,305.
Shanks et al., "OTC 23480 Enhanced Subsea Safety Critical Systems", Offshore Technology Conference, pp. 1-10, May 3, 2012.
Montague et al., "Summary of Blowout Preventer (BOP) Reliability, Availability, and Maintainability (RAM) Analyses for the Bureau of Safety and Environmental Enforcement", Bureau of Safety and Environmental Enforcement, pp. 1-48, Jun. 27, 2013.
PCT Search Report and Written Opinion issued in connection with corresponding Application No. PCT/US2016/023651 dated Jun. 13, 2016.
McCord, "A Multiplex System for a Small Remotely Manned Submersible", IEEE Ocean 1975, pp. 361-364, 1975.
Hickok, "Practical Experience of Control Valve Behavior", Subsea Control and Data Acquisition: Proceedings of an international conference, London, UK, pp. 195-203, Apr. 4-5, 1990.
Martin et al., "A Proven Oil/Water/Gas Flowmeter for Subsea, Offshore Technology Conference", Offshore Technology Conference, Houston, pp. 589-596, May 6-9, 1991.
Ali et al., "Subsea Valve Actuator for Ultra Deepwater", Offshore Technology Conference, Houston, Texas, 1996 proceedings, pp. 799-809, May 6-9, 1996.
Altamiranda et al., "Intelligent Supervision and Integrated Fault Detection and Diagnosis for Subsea Control Systems", Oceans 2007 Europe, pp. 1-6, Jun. 18-21, 2007.
Wang et al., "Water Hammer Effects on Water Injection Well Performance and Longevity", Society of Petroleum Engineers, SPE International Symposium and Exhibition on Formation Damage Control,Lafayette, Louisiana, USA, pp. 1-10, Feb. 13-15, 2008.
Vetcogray, "Capital Drilling Equipment", Retrieved from http://site.ge-energy.com/businesses/ge_oilandgas/en/iterature/en/downloads/capital_drilling_equipment.pdf, pp. 1-15, 2008.
Altamiranda et al., "Condition Monitoring and Diagnosis for Subsea Control Systems. A Subsystem Prototype", Oceans 2009 Europe, pp. 1-6, May 11-14, 2009.
Whitby et al., "20KSI BOP Stack Development", SPE International, pp. 1-5, Feb. 2-4, 2010.
Tang et al., "A Dynamic Simulation Study of Water Hammer for Offshore Injection Wells to Provide Operation Guidelines", SPE Production & Operations, vol. No. 25, Issue No. 4, pp. 509-523, Nov. 2010.
Shanks et al., "OTC 23473 New Generation Control System for 20 KSI Subsea BOP", Offshore Technology Conference, pp. 1-12, May 3, 2012.
Levine et al., "BSEE and BOEM Workshop with Government of Israel Application for Permit to Drill", pp. 1-40, Jul. 24, 2012.
Cai et al., "Reliability Analysis of Subsea Blowout Preventer Control Systems Subjected to Multiple Error Shocks", Journal of Loss Prevention in the Process Industries, vol. No. 25, Issue No. 6, pp. 1044-1054, Nov. 1, 2012.
Cai et al., "Application of Bayesin Networks to Reliability Evaluation of Software Systems for Subsea Blowout Preventers", International Journal of Control and Automation, pp. 47-60, Feb. 28, 2013.
Umofia., "Risk-Based Reliability Assessment of Subsea Control Module for Offshore Oil and Gas production", Cranfield University, School of Engineering, Department of Offshore, Process and Energy Engineering, pp. 1-284, Sep. 2014.
Chazal et al., "Enhancements in Fraction Measurements and Flow Modeling for Multiphase Flowmeters" Society of Petroleum Engineers, SPE Annual Technical Conference and Exhibition, pp. 1-19, Oct. 27-29, 2014.
PCT Search Report and Written Opinion issued in connection with Related Application No. PCT/US2015/053238 dated Feb. 1, 2016.
PCT Search Report and Written Opinion issued in connection with Related Application No. PCT/US2015/055915 dated Feb. 2, 2016.
GE Oil & Gas, "GE's 20-ksi" BOP Completely Re-Engineered to Meet Demands of HPHT Reservoirs, Drilling Contractor, pp. 1-2, Feb. 17, 2016.
Cameron., "Mark III Subsea MUX BOP Control System", Drilling Pressure Control Equipment, Retrieved from http://www.c-a-m.

(56) References Cited

OTHER PUBLICATIONS com/products-and-services/drilling/drilling-pressure-control-equipment/mark-iii-subsea-mux-bop-control-system, pp. 1-4, Feb. 19, 2016.

* cited by examiner

HYDRAULIC RE-CONFIGURABLE AND SUBSEA REPAIRABLE CONTROL SYSTEM FOR DEEPWATER BLOW-OUT PREVENTERS

RELATED PATENT APPLICATIONS

This application is a non-provisional application and claims priority to and the benefit of U.S. Provisional Patent Application No. 62/155,671, filed on May 1, 2015, incorporated herein by reference in its entirety.

BACKGROUND OF THE INVENTION

1. Field

The field of invention relates generally to blowout preventer (BOP) equipment, and specifically to creating redundancy in BOP equipment to prevent and reduce the need for downtime and repairs.

2. Description of the Related Art

BOP systems are hydraulic systems used to prevent blowouts from subsea oil and gas wells. BOP equipment typically includes a set of two or more redundant control systems with separate hydraulic pathways to operate a specified BOP function. The redundant control systems are commonly referred to as blue and yellow control pods. In known systems, a communications and power cable sends information and electrical power to an actuator with a specific address. The actuator in turn moves a hydraulic valve, thereby opening fluid to a series of other valves/piping to control a portion of the BOP.

At times, the hydraulic elements in each of these redundant systems may fail to operate as intended, and necessitate that the control system switch master controls from one pod to the other. At this point, the drilling operator loses redundancy in the system, because there is no functioning back-up pod. As a result, the operator may be required to suspend operations and pull the BOP stack from the sea floor for costly downtime and repairs.

One problem with creating redundancy in hydraulic systems is that hydraulic systems are typically hard-plumbed, and are not capable of being readily re-configured or repaired. Due to size and weight constraints, functionality of the control system has been limited in the industry to only the necessary functions, and internal hydraulic redundancy has not been built into existing systems.

Previous methods for addressing system redundancy include having multiple back-up systems. Remotely operated vehicles (ROV's) and acoustic control systems have been used as back-ups; they, however, require a different controls interface and often lead to a degradation in system performance. Thus, they are often a method of last resort.

SUMMARY

Embodiments of the invention include a method for isolating leaking hydraulics in subsea equipment, wherein an operator reassigns electric controls from the surface to spare subsea valves that are connected to the equipment. The method includes isolating problem hydraulic elements so that the control pod does not require switching. Furthermore, a method of re-assigning electrical actuators to spare hydraulic valves makes it possible to replace functionality lost when a problem is isolated. After the problem is isolated and the re-assignment is completed, the original user interface remains unchanged, which mitigates risk of operator confusion. Other rig specific information is also maintained such as emergency disconnect sequences and safety interlocks, because the main controller is still active.

Also included are systems and methods of reconnecting the pod to a BOP function after isolation and re-assignment to maintain full system redundancy, performance, and interface. In the drawings submitted herewith, the following acronyms have the following meanings HVR—hydraulic variable ram, CSR—casing shear ram, BSR—blind shear ram, ROV—remotely operated vehicle.

Each of the parts shown in the system topology view may not be required in the exact configuration shown. In embodiments where a different "standard" flow path for a hydraulic system is used, the redundant flow paths of the present technology can be updated to look different, but act the same. For example, in some embodiments the flow path can be as follows: manual regulator to pod select to hydraulic regulator to solenoid to sub-plate mounted (SPM) component to shuttle to the BOP. In alternate embodiments, components can be removed, added, or reordered as desired in the flow path to create different redundant paths. Those elements shown in the drawings are typical, but other manifestations could be made.

Embodiments of the invention herein shown and described have many benefits and advantages. For example, with the ability to isolate, re-assign, and re-route hydraulic fluid on any of the BOP functions, the process effectively provides a means of subsea control pod repair while maintaining total system redundancy. In addition, the hydraulic pathways are also reconfigurable, allowing operators to readily adapt the control system for additional functions or new requirements over the life of the system. This built-in spare capacity is field ready because the software and electronics are suited to the changes, and do not require additional engineering software or hardware updates. Testing of the technology described herein indicates that the methods and systems of the present invention increase control system mean time between failure (MTBF) by a factor of about 2.56. In other words, if the MTBF were about 100 days for a particular system, using embodiments of the present systems and methods could increase the MTBF to about 256 days.

Therefore, disclosed herein is a blowout preventer (BOP) system for providing additional redundancy and reliability. The system includes a first set of components including a BOP control pod with a primary regulator and a secondary regulator, where the primary regulator and the secondary regulator are arranged in a parallel configuration; a hydraulic supply line in communication with the BOP control pod; a pod select valve in communication with the primary regulator and the secondary regulator; and a bypassable hydraulic regulator in communication with the pod select valve; and a second set of components, the bypassable hydraulic regulator disposed between the pod select valve and the second set of components, where a hydraulic regulator bypass line bypasses the bypassable hydraulic regulator between the pod select valve and the second set of components.

In some embodiments, the system further includes an alternative BOP control pod, the alternative BOP control pod comprising an alternative primary regulator and an alternative secondary regulator, where the alternative primary regulator and the alternative secondary regulators are arranged in a parallel configuration; an alternative hydraulic supply line, in communication with the alternative BOP control pod; an alternative pod select valve, in communication with the alternative primary regulator and the alternative secondary regulator of the alternative BOP control pod;

and an alternative bypassable hydraulic regulator, in communication with the alternative pod select valve, where the alternative bypassable hydraulic regulator is disposed between the alternative pod select valve and an alternative set of the second set of components, and where an alternative hydraulic regulator bypass line bypasses the alternative bypassable hydraulic regulator between the alternative pod select valve and the alternative second set of components.

In some other embodiments, the second set of components further comprises a primary hydraulic manifold comprising a valve, the primary hydraulic manifold in communication with BOP stack shuttles to perform at least one function; a spare, re-assignable hydraulic manifold comprising a valve where the spare, re-assignable hydraulic manifold is operable to perform a function of the primary hydraulic manifold; and an isolation valve, where the isolation valve is operable to prevent flow from the hydraulic supply line to the primary hydraulic manifold and direct the flow from the hydraulic supply line to the spare, re-assignable hydraulic manifold.

Still in other embodiments, the alternative set of the second set of components further comprises: a primary hydraulic manifold comprising a valve, the primary hydraulic manifold in communication with BOP stack shuttles to perform at least one function; a spare, re-assignable hydraulic manifold comprising a valve where the spare, re-assignable hydraulic manifold is operable to perform a function of the primary hydraulic manifold; and an isolation valve, where the isolation valve is operable to prevent flow from the alternative hydraulic supply line to the primary hydraulic manifold and direct the flow from the alternative hydraulic supply line to the spare, re-assignable hydraulic manifold.

In some embodiments, the second set of components further comprises: a primary hydraulic manifold comprising a valve, the primary hydraulic manifold in communication with BOP stack shuttles to perform at least one function; a spare, re-assignable hydraulic manifold comprising a valve where the spare, re-assignable hydraulic manifold is operable to perform a function of the primary hydraulic manifold; and a flexible connection disposed between the spare, re-assignable hydraulic manifold and the BOP stack shuttles. In other embodiments, the flexible connection is connected between the spare, re-assignable hydraulic manifold and the BOP stack shuttles at remotely operated vehicle (ROV) stabs. In still other embodiments, the spare, re-assignable hydraulic manifold is supplied with hydraulic fluid from an alternative source selected from the group consisting of: an accumulator and a hot-line hose.

In some embodiments, the spare, re-assignable hydraulic manifold is hard-piped to ROV stabs through a selection valve. In other embodiments, the alternative set of the second set of components further comprises: a primary hydraulic manifold comprising a valve, the primary hydraulic manifold in communication with BOP stack shuttles to perform at least one function; a spare, re-assignable hydraulic manifold comprising a valve where the spare, re-assignable hydraulic manifold is operable to perform a function of the primary hydraulic manifold; and a flexible connection disposed between the spare, re-assignable hydraulic manifold and the BOP stack shuttles. In some embodiments, the flexible connection is connected between the spare, re-assignable hydraulic manifold and the BOP stack shuttles at ROV stabs.

Further disclosed herein is a blowout preventer (BOP) system for providing additional redundancy and reliability, the system including a first BOP control pod and a second BOP control pod, the first and second BOP control pods each comprising at least two redundant manual regulators in a parallel configuration; a hydraulic supply line, in communication with the first and second BOP control pods; a first bypassable hydraulic regulator in communication with the first BOP control pod and a second bypassable hydraulic regulator in communication with the second BOP control pod; a primary hydraulic manifold comprising a valve, the primary hydraulic manifold in communication with BOP stack shuttles to perform at least one function; a spare, re-assignable hydraulic manifold comprising a valve where the spare, re-assignable hydraulic manifold is operable to perform a function of the primary hydraulic manifold; and an isolation valve, where the isolation valve is operable to prevent flow from the hydraulic supply line to the primary hydraulic manifold and direct the flow from the hydraulic supply line to the spare, re-assignable hydraulic manifold.

Additionally disclosed herein is a method for increasing mean time between failures (MTBF) of a BOP system. The method includes the steps of supplying hydraulic fluid by a hydraulic supply line to components of the BOP system through a primary regulator; isolating the primary regulator when the primary regulator fails; and redirecting hydraulic fluid through a secondary regulator, where the primary regulator and secondary regulators are arranged in a parallel configuration.

In some embodiments, the method further comprises the step of supplying hydraulic fluid to components of the BOP system through a hydraulic regulator bypass line when a hydraulic regulator fails. In other embodiments, the method further includes the steps of utilizing a primary hydraulic manifold comprising a valve, where the primary hydraulic manifold is in communication with BOP stack shuttles to perform at least one function; and increasing redundancy in the BOP system with a spare, re-assignable hydraulic manifold comprising a valve where the spare, re-assignable hydraulic manifold is operable to perform a function of the primary hydraulic manifold.

Still in other embodiments, the method further comprises the steps of: utilizing a primary hydraulic manifold comprising a valve, where the primary hydraulic manifold is in communication with BOP stack shuttles to perform at least one function; increasing redundancy in the BOP system with a spare, re-assignable hydraulic manifold comprising a valve where the spare, re-assignable hydraulic manifold is operable to perform a function of the primary hydraulic manifold; and connecting a flexible connection between the spare, re-assignable hydraulic manifold and the BOP stack shuttles.

In some embodiments, the method includes the step of connecting the flexible connection between the spare, re-assignable hydraulic manifold and the BOP stack shuttles at ROV stabs. Still in other embodiments, the method includes the step of supplying the spare, re-assignable hydraulic manifold fluid from an alternative source selected from the group consisting of: an accumulator and a hot-line hose. In other embodiments, the spare, re-assignable hydraulic manifold is hard-piped to ROV stabs through a selection valve.

BRIEF DESCRIPTION OF THE DRAWINGS

These and other features, aspects, and advantages of the present disclosure are better understood with regard to the following Detailed Description of the Preferred Embodiments, appended Claims, and accompanying Figures.

DETAILED DESCRIPTION OF THE PREFERRED EMBODIMENTS

The Specification, which includes the Summary, Brief Description of the Drawings and the Detailed Description of the Preferred Embodiments, and the appended Claims refer to particular features (including process or method steps) of the disclosure. Those of skill in the art understand that the invention includes all possible combinations and uses of particular features described in the Specification. Those of skill in the art understand that the disclosure is not limited to or by the description of embodiments given in the Specification. The inventive subject matter is not restricted except only in the spirit of the Specification and appended Claims.

Those of skill in the art also understand that the terminology used for describing particular embodiments does not limit the scope or breadth of the disclosure. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this invention belongs unless defined otherwise.

As used in the Specification and appended Claims, the singular forms "a", "an", and "the" include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced. The verb "couple" and its conjugated forms means to complete any type of required junction, including electrical, mechanical or fluid, to form a singular object from two or more previously non-joined objects. If a first device couples to a second device, the connection can occur either directly or through a common connector. "Optionally" and its various forms means that the subsequently described event or circumstance may or may not occur. The description includes instances where the event or circumstance occurs and instances where it does not occur.

Figure 1:
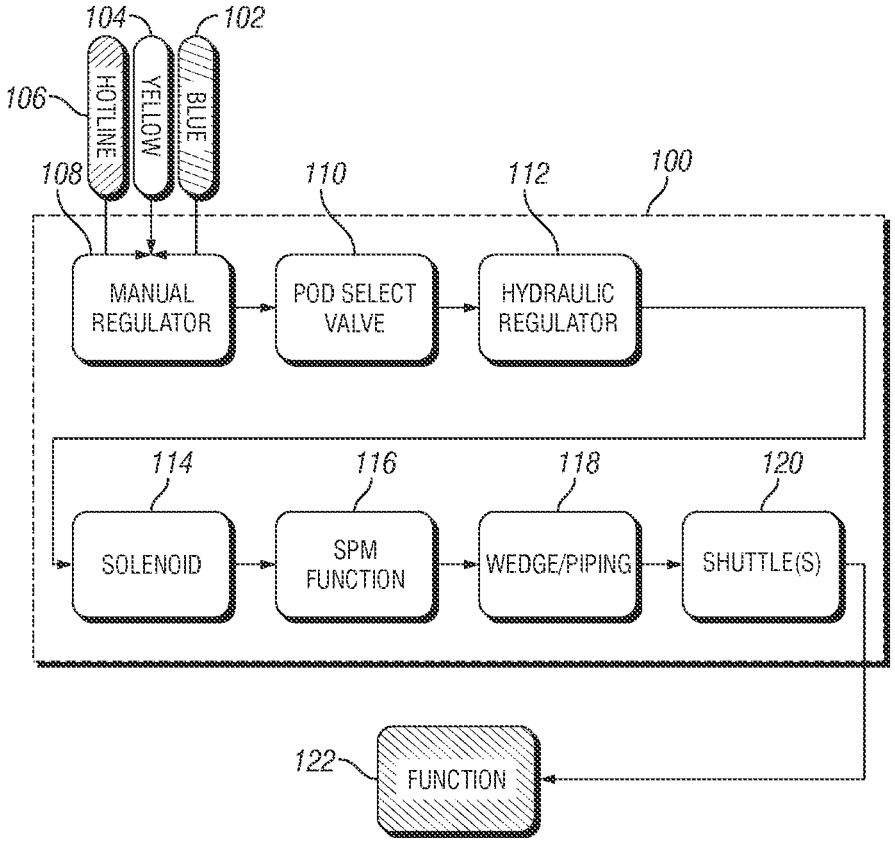
FIG. 1 is a representative reliability block diagram of a blowout preventer (BOP) control pod.

Referring first to FIG. 1, a representative reliability block diagram of a blowout preventer (BOP) control pod is shown. BOP control pod 100 is in communication with blue line 102, yellow line 104, and hotline hose 106. In practice, two control pods are used for redundancy in BOP systems, one as the active pod and one as the back-up, or redundant, pod. These are referred to as the "blue" and "yellow" pods. The hotline hose 106 supplies hydraulic fluid from the surface to control pod 100, which is mounted on a lower marine riser package (LMRP) (see 1402 in FIG. 14). The LMRP and control pod 100 are subsea components when in use. The LMRP is disposed above the BOP stack (see 1404 in FIG. 14). Blue line 102 and yellow line 104 provide redundancy for the hotline hose 106.

BOP control pod 100 includes certain upstream and downstream components, described in detail below with regard to FIG. 2. These can include, for example, a manual regulator 108, a pod select valve 110, a hydraulic regulator 112, a solenoid 114, a sub-plate mounted (SPM) function valve 116, a wedge, or piping, 118, and shuttles 120. These components are in fluid communication with one another, and interact to execute a function 122 in a BOP system. In some embodiments, the BOP system can have up to 96 functions, or more. Manual regulator 108, pod select valve 110, and hydraulic regulator 112 are typically common to all of the functions executed in a BOP system, while separate series of solenoids, SPM function valves, wedges, or piping, and shuttles exist for the separate functions.

Leakage of an element within a hydraulic pathway typically leads to switching of the control pod, such as for example from the blue pod to the yellow pod or vice versa. Such a switch leads to loss of redundancy between the pods. For example, if an element within hydraulic pathway in BOP control pod 100 leaks, such as hydraulic regulator 112, BOP control pod 100 can be deactivated for repair, and an alternative control pod can be used. However, in deactivating BOP control pod 100 and activating an alternative BOP control pod, redundancy in the system would be lost. While some or all critical functions may remain fully redundant, loss of any function in the control pod may require a switch and subsequent loss of redundancy.

Field studies have shown that SPM valves and solenoids are generally more reliable than regulators, shuttles, hoses, and piping. Thus, an SPM valve that cuts off flow in one path and opens flow in another path will increase availability, as its reliability does not impact the system as much as the functional elements it is making redundant. In other words, adding more reliable components to increase redundancy is more effective than adding components with increased risk of failure. By using the most reliable components, such as SPM valves and solenoids, to isolate paths with a failed component and open a new path, system availability is increased.

Figure 2:
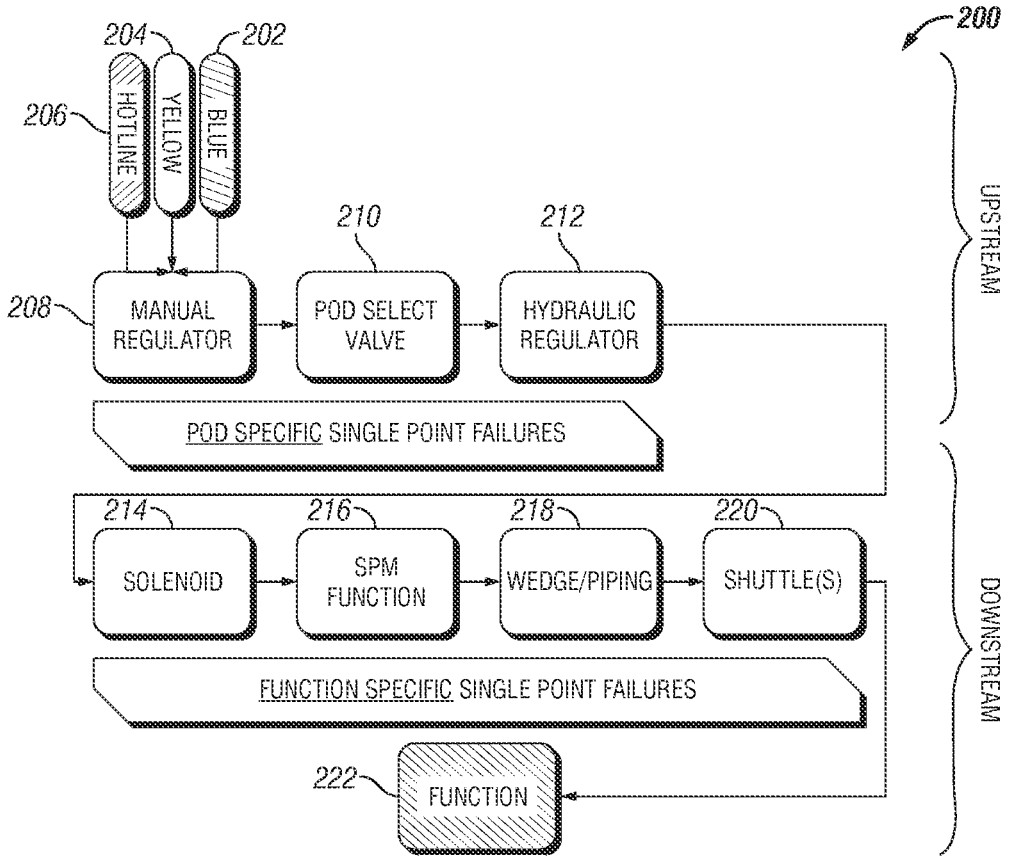
FIG. 2 is a representative block diagram showing the upstream, or a first set, of components and the downstream, or a second set, of components for a BOP system.

Referring now to FIG. 2, a representative block diagram is provided showing example upstream, also called a first set, and downstream, also called a second set, components for a BOP system. As shown, the BOP control pod 200 includes certain upstream and downstream components. The upstream components can include, for example, a manual regulator 208, a pod select valve 210, and a hydraulic regulator 212. Downstream components can include, for example, a solenoid 214, an SPM function valve 216, a wedge, or piping, 218, and shuttles 220. These components can be in fluid communication with one another, and interact to execute a function 222 in a BOP system. In some embodiments, the BOP system can have up to about 96 functions, or more. Manual regulator 208, pod select valve 210, and hydraulic regulator 212 are typically common to all of the functions executed in a BOP system, while separate series of solenoids, SPM functions, wedges, or piping, and shuttles can exist for the separate functions.

Figure 3:
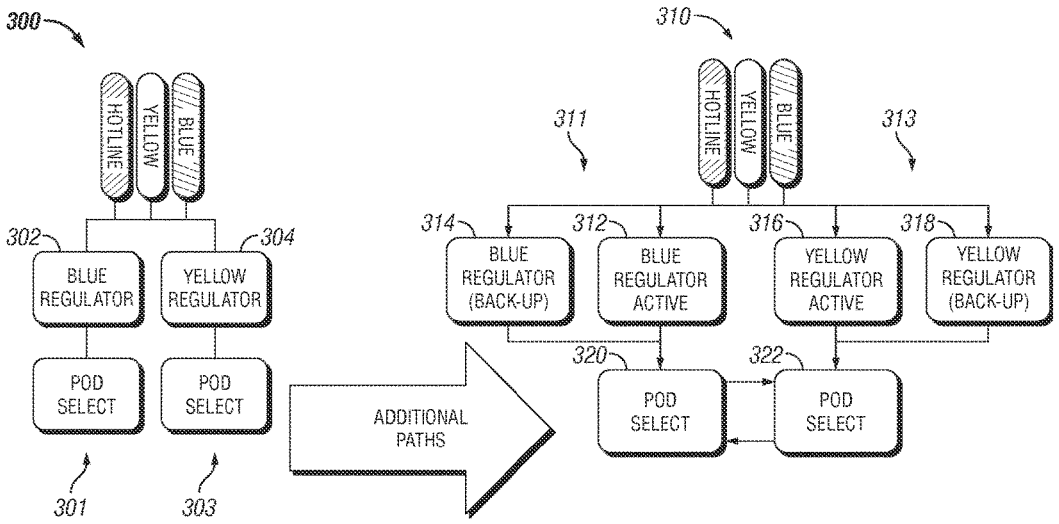
FIG. 3 is a representative block diagram showing added redundancy in a BOP system in one embodiment of the disclosure.

Referring now to FIG. 3, a representative block diagram showing added redundancy in a BOP system is provided for one embodiment of the disclosure. In a standard BOP arrangement 300, a blue pod 301 and a yellow pod 303 have a blue manual regulator 302 and a yellow manual regulator 304, respectively. If either regulator were to malfunction and need repair, the system would be deactivated, and redundancy between the blue and yellow pods would be lost. However, in the redundant BOP arrangement 310, additional paths are provided. For example, active blue manual regulator 312 is in a parallel configuration with a back-up blue manual regulator 314 in blue BOP control pod 311, and active yellow manual regulator 316 is in a parallel configuration with back-up yellow manual regulator 318 in yellow BOP control pod 313.

As shown in FIG. 3, the manual regulators 312, 314, 316, and 318 are in fluid communication with pod select valves 320, 322, which are themselves optionally in communication with one another. Under normal operations, either blue BOP control pod 311 or yellow BOP control pod 313 is active, with the respective active regulator being operational.

However, if the active regulator fails in the active control pod, the back-up blue manual regulator 314 or the back-up yellow manual regulator 318 takes the place of the failing, or otherwise not completely functional, manual regulator (depending on which pod is active), and redundancy is maintained between the blue BOP control pod 311 and yellow BOP control pod 313. The optional fluid communication between pod select valves 320, 322 provides additional redundancy in the redundant BOP arrangement 310, because both blue BOP control pod 311 and yellow BOP control pod 313 could use all four regulators 312, 314, 316, 318 if required.

The added redundancy within the manual regulators prevents downtime if a certain manual regulator needs repair, because even with the loss of one unit, redundancy is not lost between the blue and yellow pods.

Figure 4:
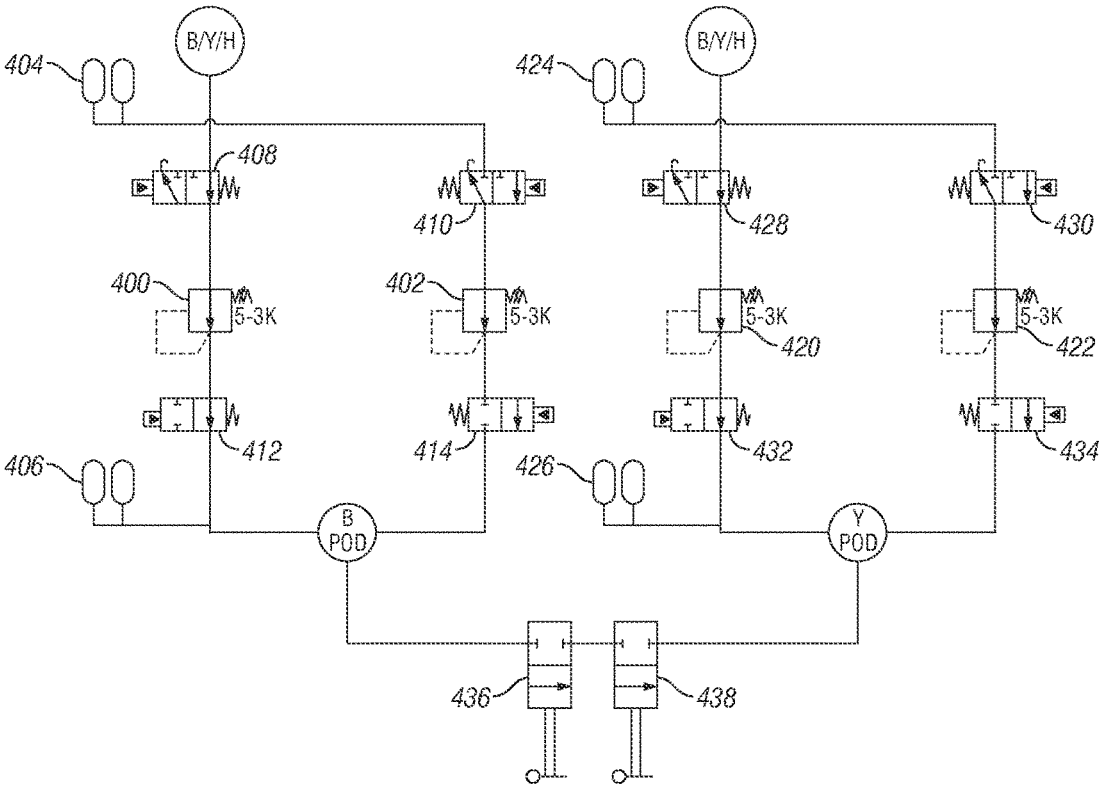
FIG. 4 is a schematic diagram of the representative block diagram shown in FIG. 3.

Referring now to FIG. 4, a schematic diagram of the representative block diagram shown in FIG. 3 is provided. As shown, active blue manual regulator 400 and back-up blue manual regulator 402 are disposed in a parallel configuration between accumulators 404, 406. Valves 408, 410, 412, and 414 are also shown. As shown, manual regulators 400, 402 can be external to or outside of the blue control pod.

Similarly, active yellow manual regulator 420 and back-up yellow manual regulator 422 are arranged in a parallel configuration between accumulators 424, 426. Valves 428, 430, 432, and 434 are also shown. Manual regulators 420, 422 are external to or outside of the yellow control pod. The added redundancy within the manual regulators prevents downtime if a certain manual regulator needs repair, because even with the loss of one unit, redundancy is not lost between the blue and yellow pods. In either circuit, the active manual regulators 400, 420 can be isolated by the valves in case of failure and replaced by a back-up manual regulator 402, 422. Thus, redundancy is maintained even with the failure of one or both active manual regulators 400, 420.

In the embodiment of FIG. 4, under normal conditions, with a control switch (not pictured) in an "off" state, a hydraulic supply is provided and travels from valve 408 to valve 412 through active blue manual regulator 400. Back-up blue manual regulator 402 is isolated. Under normal conditions, back-up blue manual regulator 402 is vented to the atmosphere, which is a design feature for safety and limiting stress on the system from sea water pressure. When the control switch is changed to an active "on" state, the functionality is the reverse where the hydraulic supply is provided and travels from valve 410, through back-up blue manual regulator 402, to valve 414. In the "on" state, regulator 400 is isolated, and is in the vented position for safety and stress reduction.

One of skill in the art will realize that while valves 408, 410, 412, 414, 428, 430, 432, and 434 are shown as hydraulically piloted, the valves could be manually actuated valves in other embodiments provided that they performed substantially similar mechanical and hydraulic functions. Additionally, in other embodiments other valve arrangements with more or fewer valves could be utilized. For example, instead of eight separated 2-position valves, there could be fewer valves that have more integral positions. For example, valves 408 and 410 could be replaced by a single valve with multiple ports and positions.

BOP control systems use a variety of hydraulic control valves to operate blow out preventers. Normally-closed, 3-way, 2-position solenoid valves can be attached to a multiplex electronic control system to pilot normally closed SPM valve functions. In some embodiments, two solenoids and two SPM valves are required to operate a function. Both are normally closed. One solenoid is on or active and one is off or inactive. This will open or close the associated SPM valves to direct fluid in the correct direction. Flow from either control pod can be supplied to the function through the use of a shuttle valve, which is self-piloting based on which control pod is selected. Additional valves provide increased availability through the use of additional flow paths and by creating re-configurable valves.

A normally open valve can be used for isolation of a leaking circuit. Such a valve can be a hydraulically actuated or manual valve of various types such as SPM, ball valve, or a shear seal. Hydraulically piloted valves show distinct safety and availability increases due to software control; however, manual valves can be selected for increased reliability and decreased maintenance of a BOP system. Two, three, or four way valves can suffice provided they can isolate upstream supply to the hydraulic leak and provide sufficient flow rates to the hydraulic circuit.

A selector valve may be used in place of shuttles to send hydraulic fluid to the function after reassignment. The selector valve normally supplies fluid through the upstream shuttle bank to the function but may be switched to a secondary position that allows fluid from the reassigned source. This source can be a hard-piped supply from the control pod, supply from an ROV port, or a separate subsea accumulator bank such as a set of stack mounted accumulators. Each method provides advantages of reliability, flexibility, and system safety.

Hydraulically isolating regulators in parallel is a useful feature to maintain stability. Without the circuit being implemented as designed with the ability to isolate before switching regulators, instability of the hydraulic flow can occur which will damage equipment. In the instance that both manual regulators 400, 402 would fail subsea, the option is available for them to both be isolated and for regulated pressure to be supplied from the opposite control pod.

In the embodiment of FIG. 4, valves 408, 410, 412, 414, 428, 430, 432, and 434 are shown as hydraulically actuated valves. In other embodiments any one of or any combination of these valves could be manual valves to be actuated by an ROV. FIG. 4 also shows manually actuated ball pod select valves 436, 438 with optional crossover between them providing fluid communication, similar to that shown between pod select valves 320, 322 in FIG. 3. While valves 436, 438 are shown as manually actuated ball pod select valves, in other embodiments the valves could be hydraulically actuated. The optional fluid communication between pod select valves 436, 438 provides additional redundancy, because both pods could use all four regulators 400, 402, 420, 422 if required.

Figure 5:
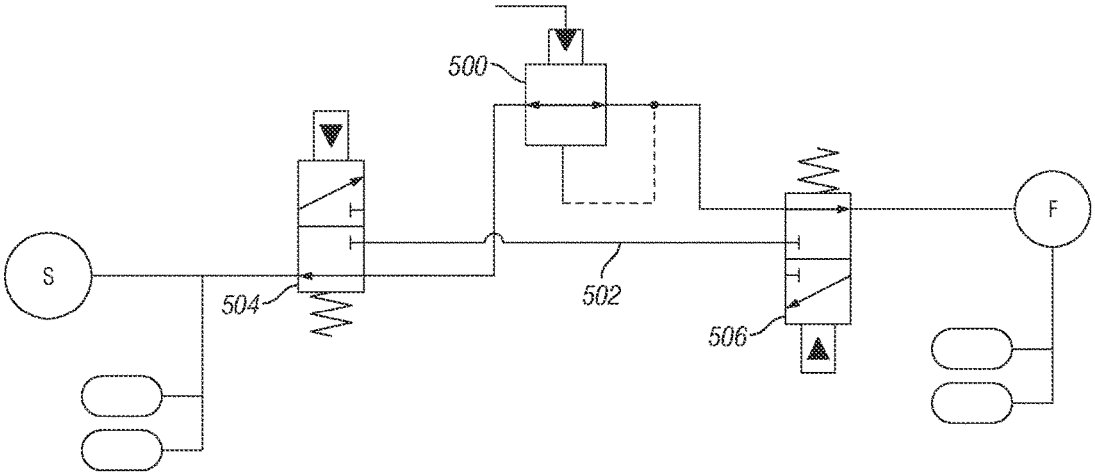
FIG. 5 is a schematic diagram of a hydraulically-piloted regulator bypass.

Referring now to FIG. 5, a schematic diagram of a hydraulically-piloted regulator with a bypass is shown. This alignment shows in greater detail how the hydraulic circuit can bypass a component, such as a regulator, if needed. To provide additional reliability to a BOP system, and to avoid losing redundancy between control pods, hydraulically-piloted regulator 500 can be bypassed by bypass line 502 between valves 504, 506. If the hydraulically-piloted regulator 500 were to stop operating correctly, bypass line 502 could be used between valves 504, 506. While this may cause a decrease in functionality of a BOP system, function redundancy and system availability is maintained.

In the embodiment of FIG. 5, while valves 504 and 506 are shown as hydraulic pilot valves, one or both could be manual valves in other embodiments. Hydraulically-piloted regulator 500 in other embodiments could be a manually-adjustable regulator.

Figure 6:
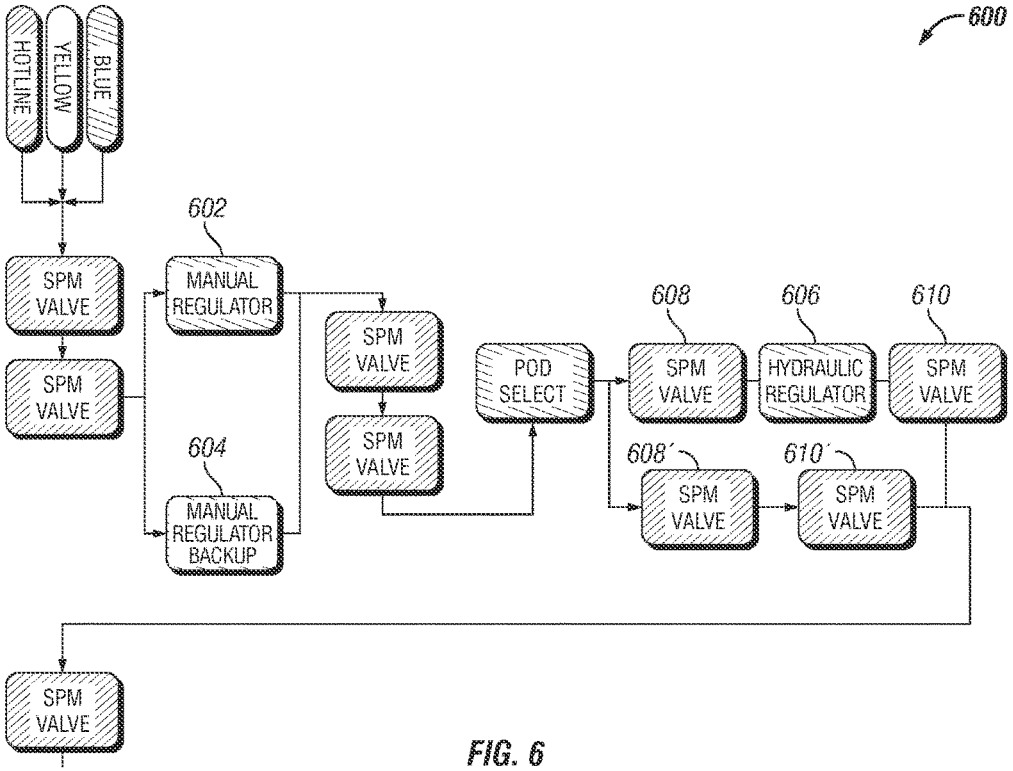
FIG. 6 is a representative reliability block diagram showing added redundancy in the first set of components of a BOP system in one embodiment of the present disclosure.

Now referring to FIG. 6, a representative reliability block diagram showing added redundancy in the upstream components of a BOP system is provided for one embodiment of the present disclosure. FIG. 6 represents the increased reliability brought about by the embodiments of FIGS. 3-5. Upstream components 600 can include, for example, manual regulators 602, 604, which are in a parallel configuration to provide redundancy in case of the failure of one manual regulator. Hydraulic regulator 606 is bypassable (as described with regard to FIG. 5) by SPM valves 608, 610 being actuated to the 608', 610' position. While this may cause a decrease in functionality of a BOP system, function redundancy is maintained.

Figure 7:
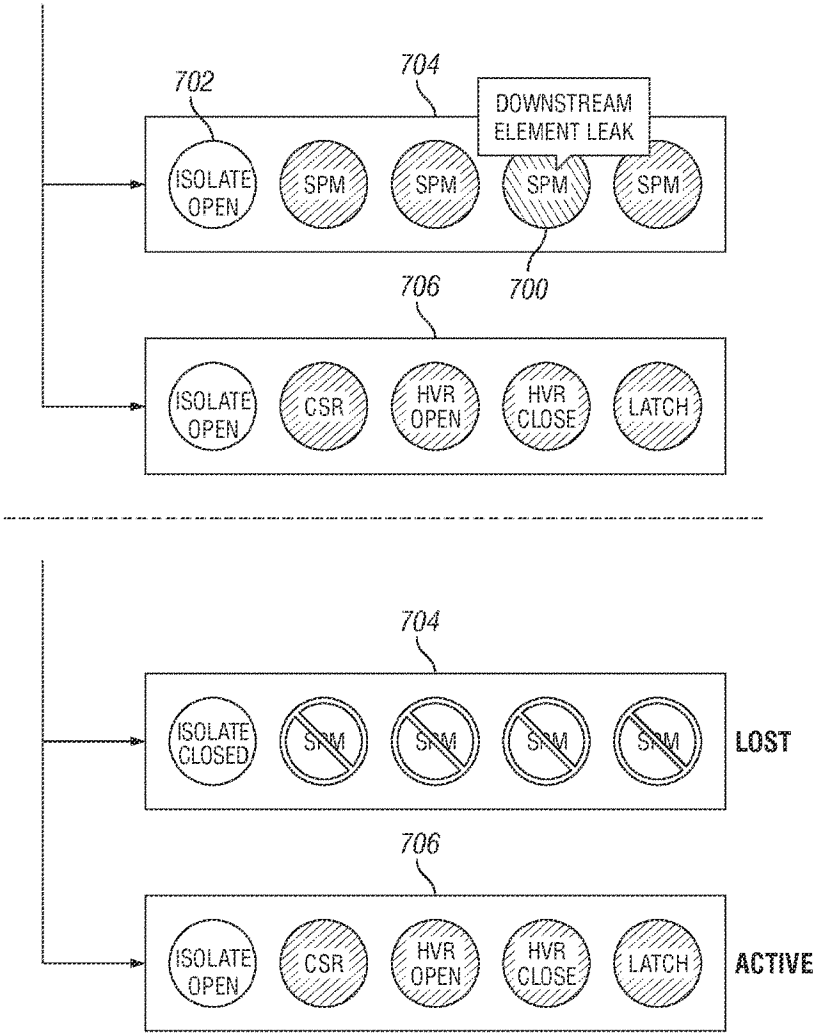
FIG. 7 is a perspective view showing loss of a hydraulic manifold due to a downstream element leak in a BOP system.

Referring now to FIG. 7, a perspective view is provided showing loss of a hydraulic manifold due to a downstream element leak in a BOP system. A downstream element such as an SPM valve (also shown in FIG. 2) can malfunction or require maintenance, such as, for example, in the case of a leak. In the case of a leak, such as that shown in FIG. 7, the manifold with the problematic element can be isolated. As shown, the leaking SPM valve 700 is isolated by closing isolation valve 702; however, the whole of manifold 704 is lost, while manifold 706 remains active. Thus, certain functionality is reduced. In order to avoid the loss of functionality and increase system availability, one or more spare hydraulic manifolds can be introduced and used with solenoid reassignment, as shown, for example, in FIG. 8.

Figure 8A:
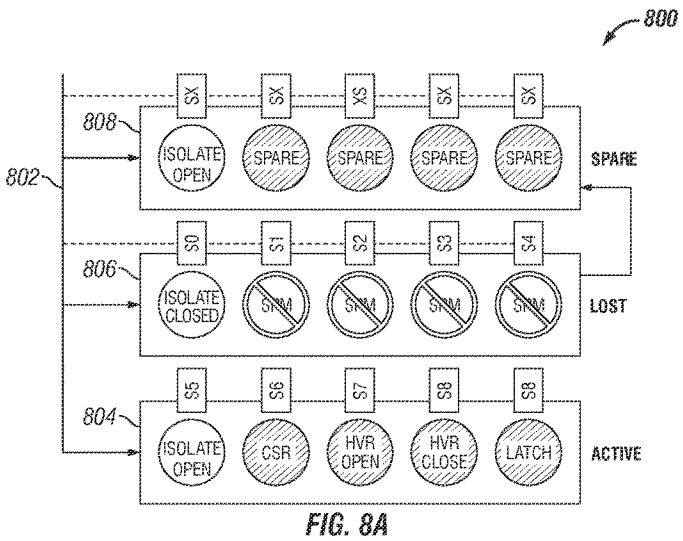
FIGS. 8A and 8B are perspective views showing loss of a hydraulic manifold and replacement and reassignment with a spare hydraulic manifold in a BOP system of the present disclosure.
Figure 8B:
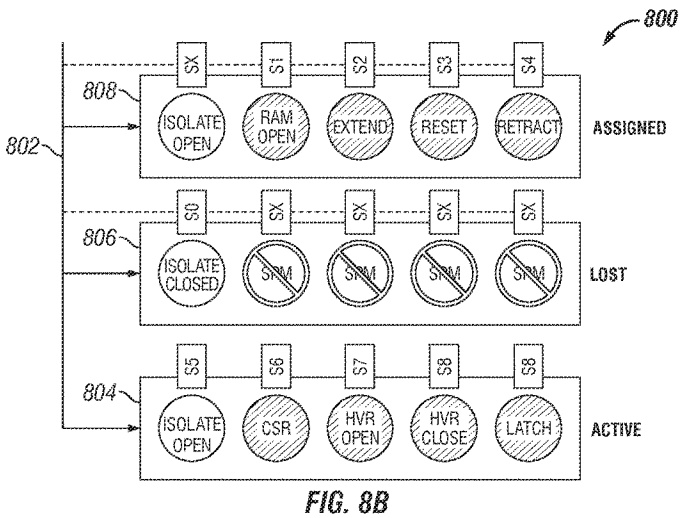

Referring now to FIG. 8, a perspective view is provided showing loss of a hydraulic manifold, and replacement and reassignment with a spare hydraulic manifold in a BOP system of the present disclosure. Downstream components 800 are in communication with inlet line 802. As shown, hydraulic manifold 804 is active, but hydraulic manifold 806 is lost and is isolated. Spare hydraulic manifold 808 is reassigned to function according to the functions of the lost hydraulic manifold 806. Reassignment of the spare valves can be carried out automatically at the failure of a valve (hydraulic manifold) or a user can reassign the functions to the spare hydraulic manifold from the surface using a human machine interface (HMI) control screen.

Figure 9:
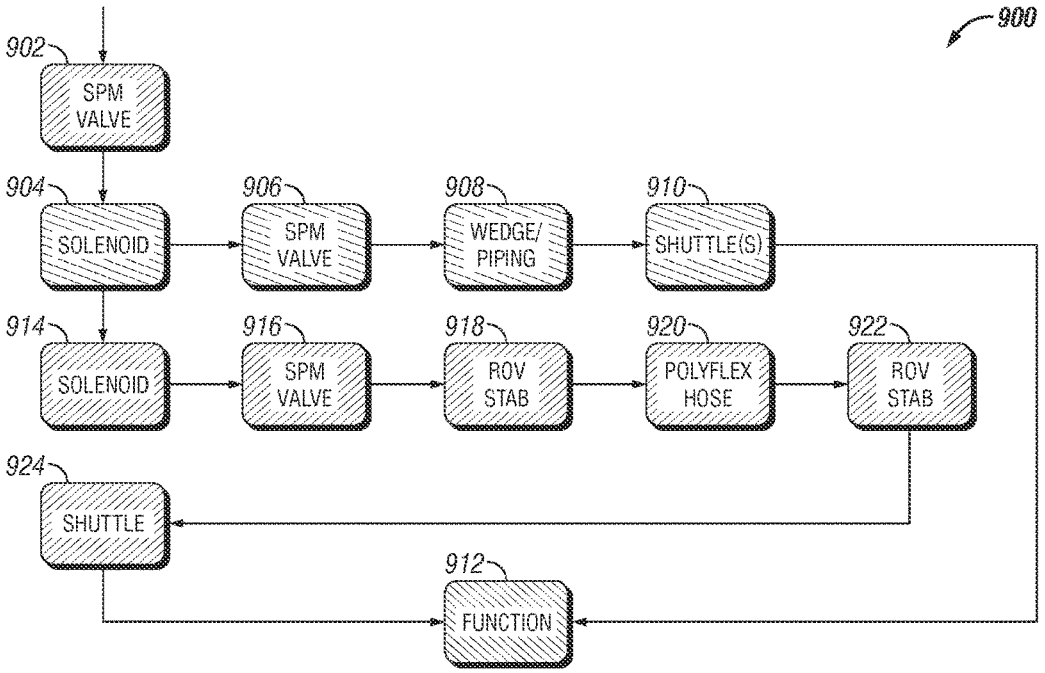
FIG. 9 is a representative reliability block diagram showing added redundancy in the downstream components of a BOP system in one embodiment of the present disclosure.

Now referring to FIG. 9, a representative reliability block diagram is provided showing added redundancy in the downstream components of a BOP system in one embodiment of the present disclosure. Downstream components 900 are disposed downstream of the upstream components 600 shown in FIG. 6. In a first mode of operation, solenoid 904 is in communication with SPM valve 906, SPM valve 906 is in communication with wedge, or piping, 908, the wedge 908 is in communication with shuttles 910, and a function 912 is carried out. However, if there is a malfunction in the downstream components in the first mode of operation, such as a leak in SPM valve 906, this valve may need to be isolated.

If SPM valve 906 must be isolated, solenoid 914 can communicate with SPM valve 916, which can be reassigned the function of SPM valve 906. In one embodiment, a remotely operated vehicle (ROV) could then be used to put ROV stab 918 in communication with a polyflex hose 920, which would subsequently be connected by ROV stab 922 to shuttle 924. Shuttle 924 is then operable to carry out function 912. In this way, redundancy is created for carrying out function 912.

Figure 10:
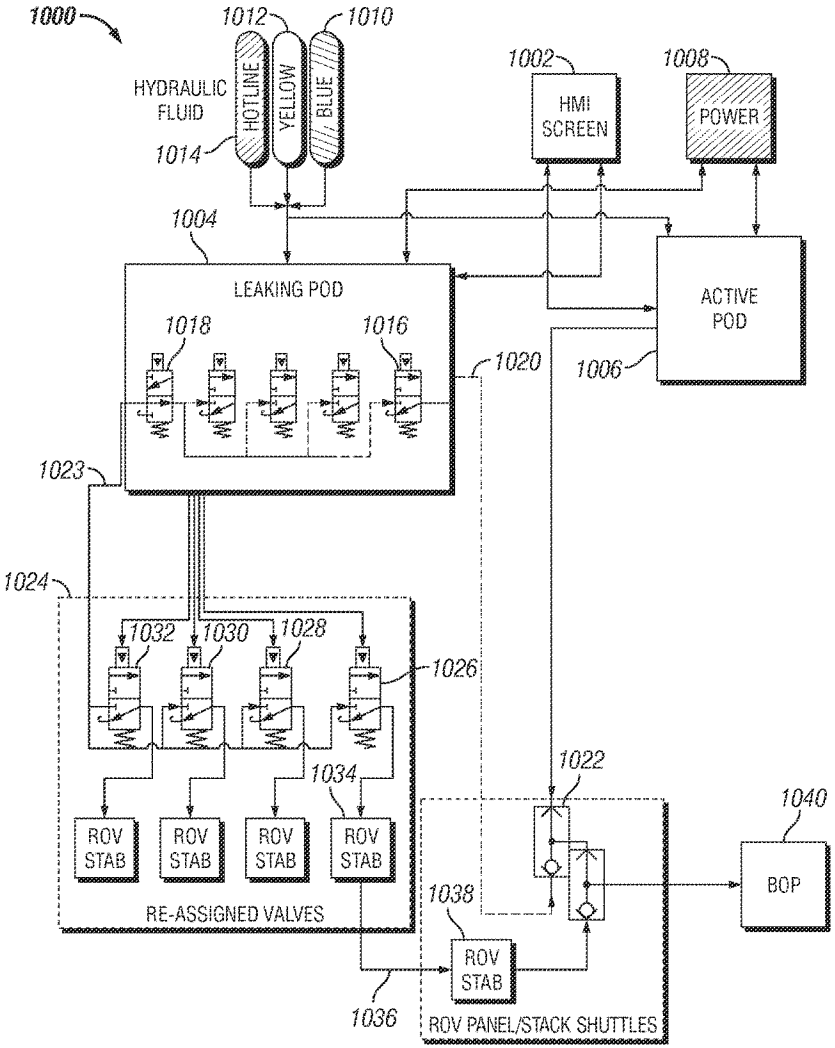
FIG. 10 is a representative block diagram showing added redundancy in the downstream components of a BOP system in one embodiment of the present disclosure.

Referring now to FIG. 10, a representative block diagram is provided showing added redundancy in the downstream components of a BOP system in another embodiment of the present disclosure. BOP system 1000 includes HMI screen 1002 used to control blue control pod 1004 and yellow control pod 1006 from the surface. HMI screen 1002 is capable of inputting commands to, and receiving data from, blue control pod 1004 and/or yellow control pod 1006. The BOP system 1000 further includes a power supply 1008, blue line 1010, yellow line 1012, and hotline 1014. Power supply 1008 provides power to the control pods 1004, 1006, and blue line 1010, yellow line 1012, and hotline 1014 redundantly provide hydraulic fluid to the control pods 1004, 1006.

In the BOP system 1000, yellow control pod 1006 is the active control pod currently in use, and blue control pod 1004 has a leaking valve 1016. The leaking valve 1016 is isolated by isolation valve 1018 by an operator via the HMI screen 1002. However, in isolating valve 1016 by way of isolation valve 1018, the connection 1020 between blue control pod 1004 and the stack shuttles 1022 is no longer active. Thus, without an alternative connection, redundancy between the blue control pod 1004, yellow control pod 1006, and the stack shuttles 1022 is lost. Losing redundancy could cause long delays as portions of BOP system 1000 are brought to the surface for repairs, or as portions of BOP system 1000 are brought offline for repair by ROVs.

Regarding stack shuttles, multiple inlet pathways exist to move the piston used to actuate the different BOP stack functions, blue and yellow control pods, acoustic control system, autoshear system, and ROV system. Shuttle valves are used to tie-in the multiple control system supply methods back to a single function. They are graphically represented as an OR Gate. Multiple shuttle valves are 'stacked' together to produce multiple input pathways for hydraulic fluid to reach the function piston. For instance, when fluid is supplied from the blue control pod, the shuttle valve shifts internally to seal off the entry point from the other control system inlets and allows the blue control pod fluid to exit the shuttle valve towards the function. Simplification of this shuttle stack is desired as it can cause failure to operate from multiple systems.

BOP system 1000, however, has redundant downstream components, and spare valve bank 1024 provides reassignable valve 1026, which can take over the functions of leaking valve 1016 by being reassigned via the HMI screen 1002, either by a user or automatically by a program, upon malfunction by leaking valve 1016. Additional spare valves 1028, 1030, and 1032 are also in communication with blue control pod 1004 and available for reassignment when additional functions of the valves in blue control pod 1004 are lost. Hydraulic line 1023 from blue control pod 1004 supplies hydraulic fluid to spare valve bank 1024 when needed. In the embodiment of FIG. 10, the spare valve bank 1024 is proximate to and optionally contained within blue control pod 1004. Although not shown in FIG. 10, yellow control pod 1006, in some embodiments, would also have reassignable, back-up valves for the yellow pod.

Reassignable valve 1026 can be made communicable with stack shuttles 1022 by flexible connection 1036 between ROV stabs 1034, 1038. Flexible connection 1036 can be a flexible hose, such as a polyflex hose, or any other suitable flexible connection for fluid communication between the ROV stabs 1034, 1038. Complete system redundancy (power and communications) is maintained in BOP system 1000, unlike in prior art systems, and the stack shuttles 1022 and BOP 1040 are in fluid communication with the active yellow control pod 1006 and the spare valve bank 1024 of blue control pod 1004.

Figure 11:
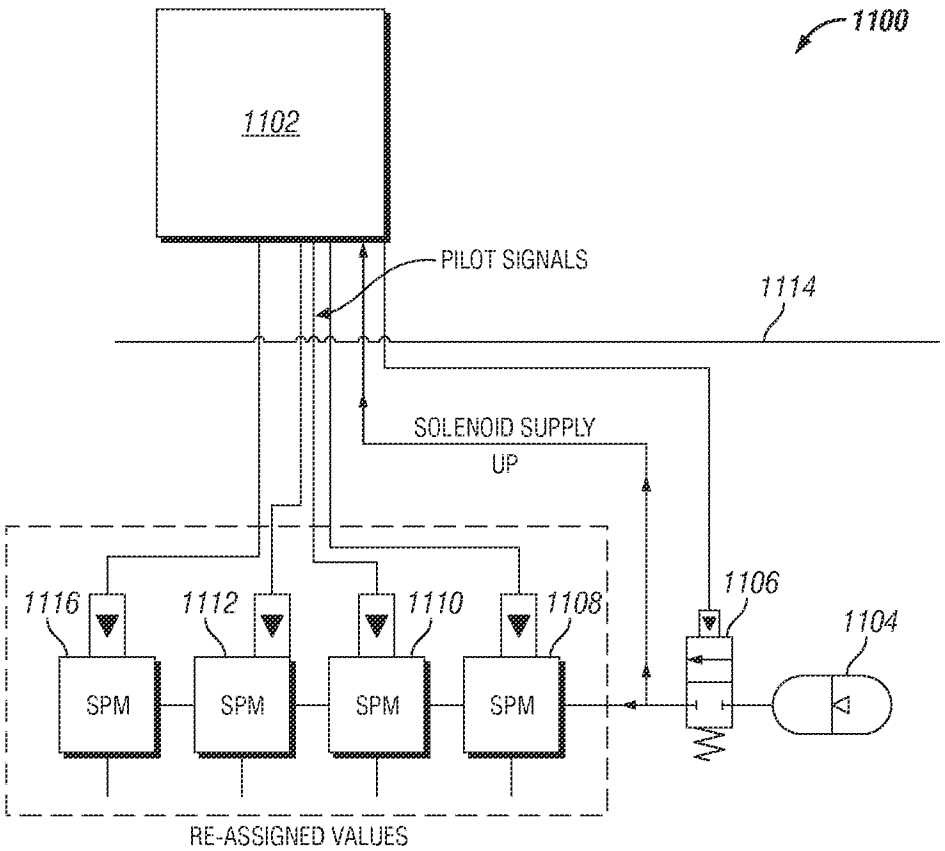
FIG. 11 is a representative block diagram showing added redundancy in the downstream components of a BOP system in one embodiment of the present disclosure.

FIG. 11 is a representative block diagram showing added redundancy in the downstream components of a BOP system in yet another embodiment of the present disclosure. In some embodiments, reassignable valves can be supplied with hydraulic fluid from an alternate source, such as an accumulator or hotline hose. BOP system 1100 includes BOP control pod 1102. In the embodiment of FIG. 11, accumulator 1104 supplies valve 1106 with an alternate source of hydraulic fluid.

In the embodiment of FIG. 11, spare valves 1108, 1110, 1112, and 1116 are located at a distance away from the BOP control pod 1102. For example, the BOP control pod 1102 can be integral with or disposed proximate to a lower-marine riser package (LMRP) above line 1114, while the spare valves 1108, 1110, 1112, and 1116 can be disposed proximate to the lower stack, below line 1114. Hydraulic fluid may be supplied to the spare valves by way of the BOP control pod 1102 or by way of the accumulator 1104 and isolation valve 1106. A pilot signal from the BOP control pod 1102 to the spare valves 1108, 1110, 1112, and 1116 can be used to activate, deactivate, and reassign the spare valves.

FIG. 11 shows a variation in the arrangement of control valves and features present in FIG. 10. BOP control pod 1102 is similar to leaking blue control pod 1004 from FIG. 10. In this configuration, the main control system link to the lower stack (below line 1114) is utilized to provide external pilot signals to spare SPM valves 1108, 1110, 1112, and 1116 located outside the main control pod. Locating the reassigned valves on the lower stack below line 1114, rather than in the control pod, allows for an easier connection to the BOP function and more room for the valve panel. Additionally, pressurized control fluid can be sent from the lower stack to the control pod and can directly supply the lower stack reassigned valves. A separate means of hydraulic supply increases availability in certain embodiments. The lower stack hydraulic supply is shown as accumulator 1104, which can hold any required volume of fluid and is provided with isolation valve 1106.

Figure 12:
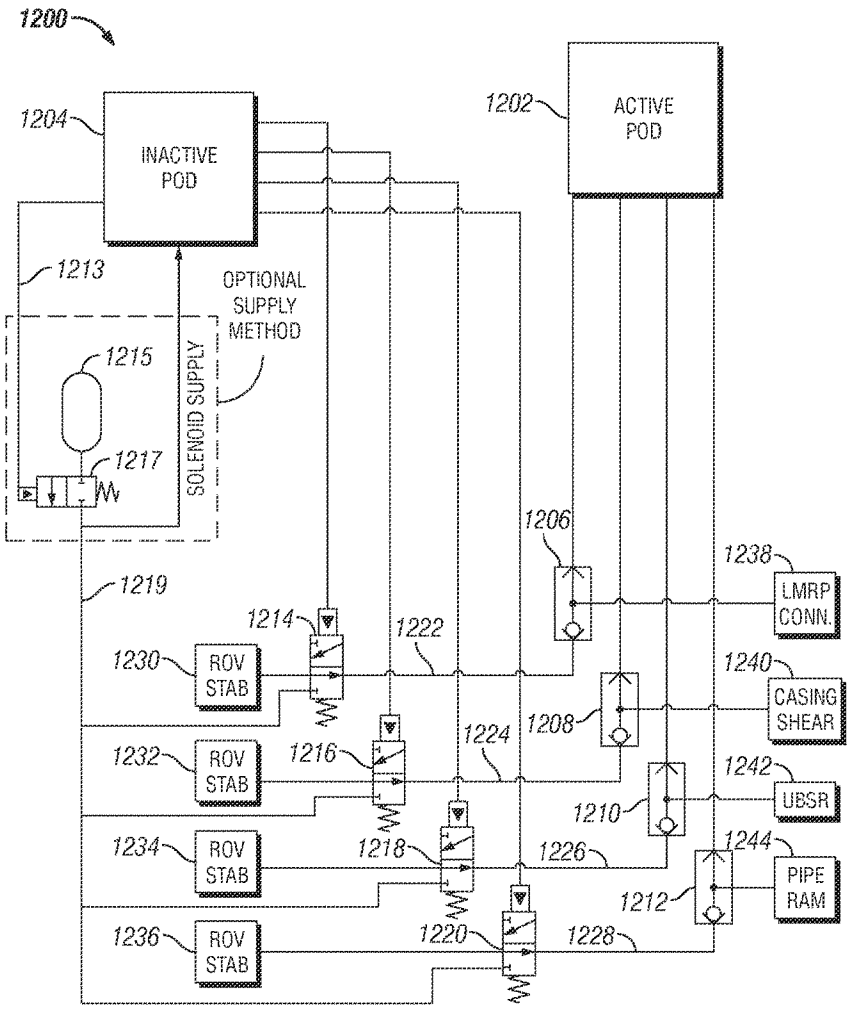
FIG. 12 is a representative block diagram showing added redundancy in the downstream components of a BOP system in one embodiment of the present disclosure.

FIG. 12 is a representative block diagram showing added redundancy in the downstream components of a BOP system 1200 in an example embodiment of the present disclosure. In the embodiment of FIG. 12, active yellow control pod 1202 and inactive blue control pod 1204 are in communication with stack shuttles 1206, 1208, 1210, and 1212. Stack shuttles 1206, 1208, 1210, and 1212 are in fluid communication with lower marine riser package (LMRP) connector 1238, casing shear ram BOP 1240, blind shear ram BOP 1242, and pipe ram 1244, respectively.

The spare function valves 1214, 1216, 1218, and 1220 can be hard-piped by lines 1222, 1224, 1226, and 1228, respectively, to BOP stack shuttles 1206, 1208, 1210, and 1212, and hard-piped to ROV stabs 1230, 1232, 1234, and 1236. This arrangement maintains the normal capabilities of an ROV to connect a flexible connection, while adding a degree of reliability to the system by way of hard-piping.

Hydraulic line 1213 and accumulator 1215 can supply hydraulic fluid by valve 1217 to hydraulic line 1219. Hydraulic line 1219 supplies spare function valves 1214, 1216, 1218, and 1220 with hydraulic fluid when blue control pod 1204 is inactive. The spare function valves are hard-piped to the stack shuttles, but can also be placed in fluid communication with the stack shuttles by ROV stabs 1230, 1232, 1234, and 1236 with flexible hoses or similar connections. In other embodiments, more or fewer spare function valves and/or more or fewer ROV stabs could be provided and used.

FIG. 12 shows a variation in the arrangement of control valves and piping from FIG. 10. In the representation of FIG. 12, accumulator 1215 is optional, and is similar to accumulator 1104 in FIG. 11. The hydraulic fluid supply can come from the main control pod or another source. Valves 1214, 1216, 1218, and 1220 are utilized as "selector" valves rather than normally closed valves. Instead of using a flying lead (such as a steel hose) from the control pod to a valve panel, a hard piped flow path, such as hydraulic line 1219, can be created that does not interfere with the normal operation of an ROV at ROV stabs 1230, 1232, 1234, and 1236. In addition, a hard piped flow path prevents the addition of one or more shuttle valves in the control system by utilizing the last shuttle already reserved for the ROV function port. The only signal necessary for operation of this circuit is a pilot fluid signal from the control pod 1204 to the valves 1214, 1216, 1218, 1220.

Figure 13:
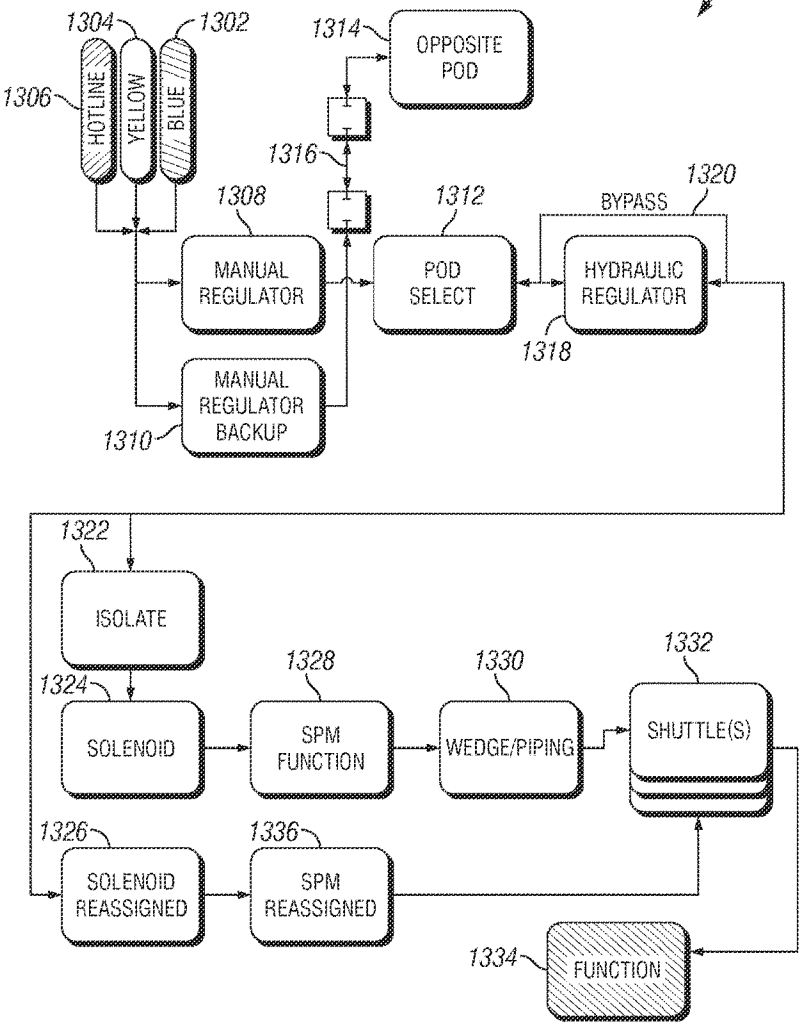
FIG. 13 is a representative reliability block diagram showing added redundancy in the first set and second set of components of a BOP system in one embodiment of the present disclosure.

FIG. 13 is a representative reliability block diagram showing added redundancy in the upstream and downstream components of a BOP system in one embodiment of the present disclosure. BOP system 1300 is supplied redundantly with hydraulic fluid by blue line 1302, yellow line 1304, and hotline 1306. Manual regulator 1308 is active, while manual regulator back-up 1310 is inactive. In the case that manual regulator 1308 becomes inactive, manual regulator 1310 can be activated. Manual regulators 1308 and 1310 are in a parallel configuration, such that the loss of one would not cause complete loss of redundancy in BOP system 1300. Pod select valves 1312 and 1314 are shown to be in fluid communication with one another by way of line 1316; however, such fluid communication between pod select valves 1312 and 1314 is optional.

Hydraulic regulator 1318 has a bypass line 1320 (similar to that described earlier with regard to FIGS. 5-6) to avoid loss in redundancy if the function of the hydraulic regulator 1318 is lost. Isolation valve 1322 either allows communication of the upstream components with solenoid 1324, or allows communication of the upstream components with solenoid 1326. Solenoid 1326 and SPM function valve 1336 can be reassigned to perform the function of solenoid 1324 and SPM function valve 1328, respectively, if solenoid 1324 is disabled and isolation valve 1322 is used to prevent flow to solenoid 1324.

Solenoid 1324 is in fluid communication with SPM function valve 1328, which itself is in fluid communication with wedge, or piping, 1330 to shuttles 1332. Shuttles 1332 are in fluid communication to carry out a function 1334 in the BOP system 1300. Solenoid 1326, which can be reassigned if solenoid 1324 is lost, is in communication with reassigned SPM function valve 1336, which is also in communication with the shuttles 1332 to carry out the function 1334 in the BOP system 1300.

Figure 14:
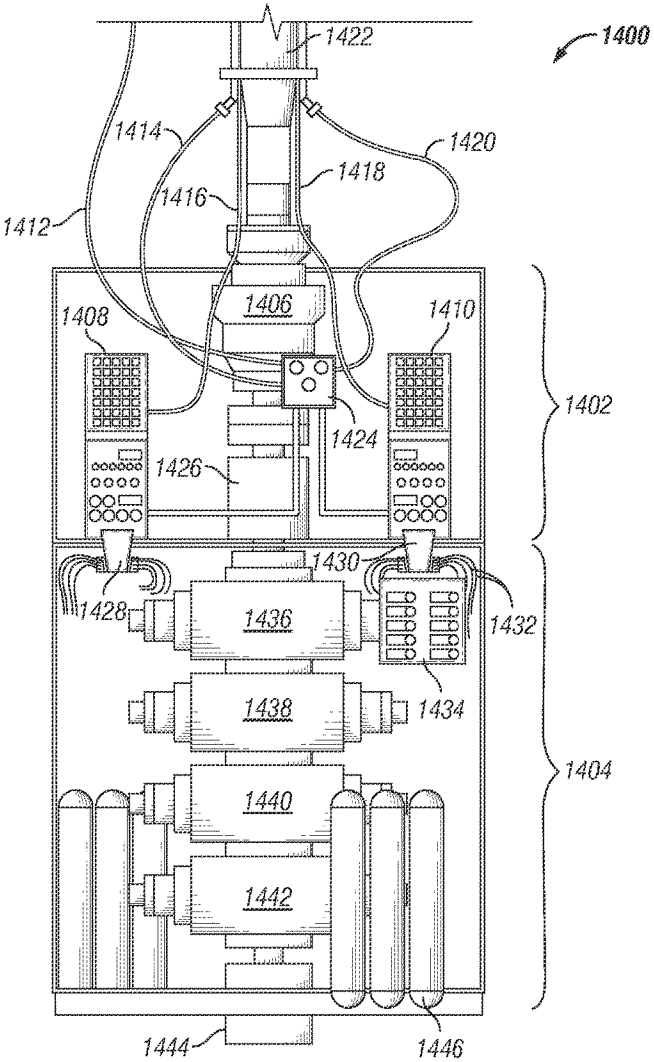
FIG. 14 is a representative system overview of a BOP stack.

Referring now to FIG. 14, a BOP stack 1400 is pictured, which includes a lower marine riser package (LMRP) 1402 and a lower stack 1404. LMRP 1402 includes an annular 1406, a blue control pod 1408, and a yellow control pod 1410. Hotline 1412, blue conduit 1414, and yellow conduit 1420 proceed downwardly from riser 1422 into LMRP 1402 and through conduit manifold 1424 to the control pods 1408, 1410. Blue power and communications line 1416 and yellow power and communications line 1418 proceed to control pods 1408, 1410, respectively. LMRP connector 1426 connects LMRP 1402 to lower stack 1404. Hydraulically activated wedges 1428 and 1430 are disposed to suspend connectable hoses or pipes 1432, which can be connected to shuttle panels.

Lower stack 1404 further includes shuttle panel 1434, blind shear ram BOP 1436, casing shear ram BOP 1438, first pipe ram 1440, and second pipe ram 1442. BOP stack 1400 is disposed above wellhead connection 1444. Lower stack 1404 further includes optional stack-mounted accumulators 1446 containing a necessary amount of hydraulic fluid.

Each of the parts shown in the system topology view may not be required in the exact configuration shown. In embodiments where a different "standard" flow path for a hydraulic system is used, the redundant flow paths of the present technology can be updated to look different, but act the same. For example, in some embodiment the flow path can be as follows: manual regulator to pod select to hydraulic regulator to solenoid to sub-plate mounted (SPM) component to shuttle to the BOP. In alternate embodiments, components can be removed, added, or reordered as desired in the flow path to create different redundant paths. Those elements shown in the drawings are typical, but other manifestations could be made.

The invention herein shown and described has many benefits and advantages. For example, with the ability to isolate, re-assign, and re-route hydraulic fluid on any of the BOP functions, the process effectively is a means of subsea control pod repair while maintaining total system redundancy. In addition, the hydraulic pathways are also reconfigurable, allowing operators to readily adapt the control system for additional functions or new requirements over the life of the system. This built-in spare capacity is field ready because the software and electronics are suited to the changes, and do not require additional engineering software or hardware updates. Testing of the technology described herein indicates that the methods and systems of the present invention increase control system mean time between failure (MTBF) by about a factor of 2.56.

The new hydraulic architecture was analyzed for its availability using reliability block diagram analysis software simulations. The availability of the system was defined by the probability of the system to perform without the consequence of a BOP stack pull. The analysis showed that the new hydraulic architecture improved system probability to perform functions on demand and decreased down-time for drilling operations significantly. The mean time between failure (MTBF) for the system increased by a factor of 2.56 while unplanned down time decreased by a margin of 60%, and improvement in mean availability of 3.5% was shown. The results validate the increased complexity and cost associated with the design architecture to provide industry leading performance at a lower total cost and with enhanced safety.

A reliability block diagram is constructed and used to evaluate the reliability of the existing and proposed design concepts. A reliability block diagram (RBD) is a diagrammatic method for showing how component reliability contributes to the success or failure of a complex system. A RBD is drawn as a series of blocks connected in parallel or series configuration. Parallel paths are redundant, meaning that all of the parallel paths must fail for the parallel network to fail. By contrast, any failure along a series path causes the entire series path to fail. Each block represents a component of the system with a failure rate. Corrective and preventive maintenance can be defined for an individual block. A large number of simulations can be performed on an RBD to calculate various reliability metrics, including Mean Time between Failures, System Availability, System Downtime, Criticality Index of each block, etc.

What is claimed is:

1. A blowout preventer (BOP) system for providing additional system redundancy in the case of reduced component functionality, the system comprising:
   - a first set of components comprising:
     - at least two BOP control pods, wherein at least one of the at least two BOP control pods comprises a primary regulator and a secondary regulator, wherein the primary regulator and the secondary regulator are arranged in a parallel configuration;
     - a hydraulic supply line in communication with at least one of the at least two BOP control pods;
     - a pod select valve in communication with the primary regulator and the secondary regulator; and
     - a bypassable hydraulic regulator in communication with the pod select valve; and
   - a second set of components, the bypassable hydraulic regulator disposed between the pod select valve and the second set of components, wherein a hydraulic regulator bypass line bypasses the bypassable hydraulic regulator between the pod select valve and the second set of components.

2. The BOP system of claim 1, further comprising:
   - an alternative BOP control pod, the alternative BOP control pod comprising an alternative primary regulator and an alternative secondary regulator, wherein the alternative primary regulator and the alternative secondary regulator are arranged in a parallel configuration;

an alternative hydraulic supply line, in communication with the alternative BOP control pod;

an alternative pod select valve, in communication with the alternative primary regulator and the alternative secondary regulator of the alternative BOP control pod; and an alternative bypassable hydraulic regulator, in communication with the alternative pod select valve, wherein the alternative bypassable hydraulic regulator is disposed between the alternative pod select valve and an alternative set of the second set of components, and wherein an alternative hydraulic regulator bypass line bypasses the alternative bypassable hydraulic regulator between the alternative pod select valve and the alternative set of the second set of components.

3. The BOP system of claim 1, wherein the second set of components further comprises:

a primary hydraulic manifold comprising a valve, the primary hydraulic manifold in communication with BOP stack shuttles to perform at least one function;

a spare, re-assignable hydraulic manifold comprising a valve wherein the spare, re-assignable hydraulic manifold is operable to perform a function of the primary hydraulic manifold; and an isolation valve, wherein the isolation valve is operable to prevent flow from the hydraulic supply line to the primary hydraulic manifold and direct the flow from the hydraulic supply line to the spare, re-assignable hydraulic manifold.

4. The BOP system of claim 2, wherein the alternative set of the second set of components further comprises:

a primary hydraulic manifold comprising a valve, the primary hydraulic manifold in communication with BOP stack shuttles to perform at least one function;

a spare, re-assignable hydraulic manifold comprising a valve wherein the spare, re-assignable hydraulic manifold is operable to perform a function of the primary hydraulic manifold; and an isolation valve, wherein the isolation valve is operable to prevent flow from the alternative hydraulic supply line to the primary hydraulic manifold and direct the flow from the alternative hydraulic supply line to the spare, re-assignable hydraulic manifold.

5. The BOP system of claim 1, wherein the second set of components further comprises:

a primary hydraulic manifold comprising a valve, the primary hydraulic manifold in communication with BOP stack shuttles to perform at least one function;

a spare, re-assignable hydraulic manifold comprising a valve wherein the spare, re-assignable hydraulic manifold is operable to perform a function of the primary hydraulic manifold; and a flexible connection disposed between the spare, re-assignable hydraulic manifold and the BOP stack shuttles.

6. The BOP system of claim 2, wherein the alternative set of the second set of components further comprises:

a primary hydraulic manifold comprising a valve, the primary hydraulic manifold being in communication with BOP stack shuttles to perform at least one function;

a spare, re-assignable hydraulic manifold comprising a valve wherein the spare, re-assignable hydraulic manifold is operable to perform a function of the primary hydraulic manifold; and a flexible connection disposed between the spare, re-assignable hydraulic manifold and the BOP stack shuttles.

7. The BOP system of claim 5, wherein the flexible connection is connected between the spare, re-assignable hydraulic manifold and the BOP stack shuttles at remotely operated vehicle (ROV) stabs.

8. The BOP system of claim 5, wherein the spare, re-assignable hydraulic manifold is supplied with hydraulic fluid from an alternative source selected form the group consisting of: an accumulator and a hot-line hose.

9. The BOP system of claim 5, wherein the spare, re-assignable hydraulic manifold is hard-piped to ROV stabs through a selection valve.

10. The BOP system of claim 6, wherein the flexible connection is connected between the spare, re-assignable hydraulic manifold and the BOP stack shuttles at ROV stabs.

11. A blowout preventer (BOP) system for providing additional redundancy in the case of reduced component functionality, the system comprising:

a first BOP control pod and a second BOP control pod, the first and second BOP control pods each comprising at least two redundant manual regulators in a parallel configuration;

a hydraulic supply line, in communication with the first and second BOP control pods;

a first bypassable hydraulic regulator in communication with the first BOP control pod and a second bypassable hydraulic regulator in communication with second BOP control pod;

a primary hydraulic manifold comprising a valve, the primary hydraulic manifold in communication with BOP stack shuttles to perform at least one function;

a spare, re-assignable hydraulic manifold comprising a valve wherein the spare, re-assignable hydraulic manifold is operable to perform a function of the primary hydraulic manifold; and an isolation valve, wherein the isolation valve is operable to prevent flow from the hydraulic supply line to the primary hydraulic manifold and direct the flow from the hydraulic supply line to the spare, re-assignable hydraulic manifold.

12. A method for increasing mean time between failures (MTBF) of a BOP system comprising at least two BOP control pods, the method comprising the steps of:

supplying hydraulic fluid by a hydraulic supply line to components of the BOP system through a primary regulator of at least one of the at least two BOP control pods;

isolating the primary regulator when the primary regulator has reduced functionality; and redirecting hydraulic fluid through a secondary regulator of the at least one of the at least two BOP control pods, wherein the primary regulator and secondary regulator are arranged in a parallel configuration within the at least one of the at least two BOP control pods.

13. The method of claim 12, further comprising the step of:

supplying hydraulic fluid to a set of components of the BOP system through a hydraulic regulator bypass line when a hydraulic regulator fails.

14. The method of claim 12, further comprising the steps of:

utilizing a primary hydraulic manifold comprising a valve, wherein the primary hydraulic manifold is in communication with BOP stack shuttles to perform at least one function; and increasing redundancy in the BOP system with a spare, re-assignable hydraulic manifold comprising a valve wherein the spare, re-assignable hydraulic manifold is operable to perform a function of the primary hydraulic manifold.

15. The method of claim 12, further comprising the steps of:

utilizing a primary hydraulic manifold comprising a valve, wherein the primary hydraulic manifold is in communication with BOP stack shuttles to perform at least one function;

increasing redundancy in the BOP system with a spare, re-assignable hydraulic manifold comprising a valve wherein the spare, re-assignable hydraulic manifold is operable to perform a function of the primary hydraulic manifold; and connecting a flexible connection between the spare, re-assignable hydraulic manifold and the BOP stack shuttles.

16. The method of claim 15, further comprising the step of connecting the flexible connection between the spare, re-assignable hydraulic manifold and the BOP stack shuttles at ROV stabs.

17. The method of claim 15, further comprising the step of supplying the spare, re-assignable hydraulic manifold fluid from an alternative source selected from the group consisting of: an accumulator and a hot-line hose.

18. The method of claim 15, wherein the spare, re-assignable hydraulic manifold is hard-piped to ROV stabs through a selection valve.

19. The method of claim 12, further comprising the step of reassigning functions of a primary hydraulic manifold to a spare, re-assignable hydraulic manifold.

20. The method of claim 14, further comprising the step of reassigning functions of the primary hydraulic manifold to the spare, re-assignable hydraulic manifold.

* * * * *